United States Patent [19]

Ferrari

[11] Patent Number: 4,748,942

[45] Date of Patent: Jun. 7, 1988

[54] REPLACEMENT ELEMENT FOR AUTOMOBILE THERMOSTAT

[76] Inventor: Walter Ferrari, 19745 Valley Blvd., Walnut, Calif. 91789

[21] Appl. No.: 100,558

[22] Filed: Sep. 21, 1987

[51] Int. Cl.[4] ..... F01P 7/14

[52] U.S. Cl. ..... 123/41.02; 123/41.08

[58] Field of Search ..... 123/41.08, 41.02, 41.01; 165/51, 96; 137/340, 269; 138/40, 44

[56] References Cited

U.S. PATENT DOCUMENTS

| | | | |
|---|---|---|---|
| Re. 32,434 | 6/1987 | Avrea | 165/51 X |
| 1,189,786 | 7/1916 | Byrnes | 123/41.02 |
| 2,005,385 | 6/1935 | O'Hara | 138/44 X |
| 2,330,564 | 9/1943 | Dyer | 138/44 X |
| 3,696,620 | 10/1972 | Pace | 123/41.08 X |

FOREIGN PATENT DOCUMENTS

| | | | |
|---|---|---|---|
| B 23055 | 10/1955 | Fed. Rep. of Germany | 138/44 |
| 2056557 | 5/1972 | Fed. Rep. of Germany | 138/44 |
| 96150 | 4/1960 | Norway | 123/41.02 |

*Primary Examiner*—Tony M. Argenbright
*Assistant Examiner*—Eric R. Carlberg
*Attorney, Agent, or Firm*—James E. Brunton

[57] ABSTRACT

A thermostat replacement element which can be used in place of the thermostat recommended for use in a particular type of automobile. The replacement element can be specifically configured to closely replicate the restriction to flow of fluid through the coolant system offered by the specified thermostat when the thermostat is in a fully open condition.

5 Claims, 1 Drawing Sheet

REPLACEMENT ELEMENT FOR AUTOMOBILE THERMOSTAT

BACKGROUND OF THE INVENTION

1. Field of the Invention

The present invention relates generally to flow control devices for use in liquid cooled engines. More particularly, the invention concerns a flow control element which can be used in place of conventional thermostat units of the character typically provided in cooling systems for internal combustion engines.

2. Discussion of the Prior Art

As a general rule, internal combustion engines are cooled by the circulation of a liquid coolant through the block and head of the engine and through a radiator. Air is drawn through the radiator by a fan driven by the engine and by the motion of the vehicle as the vehicle moves along the highway. The heat from the liquid coolant is thus dissipated by the air flowing past the radiator. In recent years cooling systems comprise a sealed system adapted to be operated under pressure. Increased pressure in the system raises the boiling point of the liquid and accordingly, raises the operating temperature at which the coolant may be maintained during operation of the system.

When the cooling system of the internal combustion engine of the character found in the typical automobile is operated under pressure, the thermostat performs the function of controlling the rate of circulation of coolant within the system in accordance with the temperature of the coolant. More particularly, the thermostat is adapted to reduce the amount of coolant flowing through the cooling system when the coolant has reached a predetermined low temperature. In this low temperature operating mode, the engine is capable of operating at peak efficiency without a large volume of coolant flowing through the system. Conversely, when the coolant reaches a predetermined high temperature, the thermostat opens to enable a larger volume of coolant to flow through the cooling system to maintain optimum engine performance.

Many parts of the United States experience wide temperature variations from season to season. When the automobile must perform during the winter months at sub-zero temperatures and during the summer months at very high ambient temperatures, use of the thermostat is extremely important. In conditions of widely varying ambient temperatures, the thermostat performs the vital function of controlling the rate of flow of coolant in a manner to insure peak performance of the internal combustion engine regardless of the outside temperature. However, in moderate climates, where outside temperatures are usually high and the temperature variations are slight from season to season, the thermostat plays a much less important role, since the thermostat normally functions in an open condition.

A major problem inherent in many prior art thermostat units is the fact that when the unit fails, it typically fails in a closed condition. When the thermostat fails in this manner, inadequate fluid flow through the cooling system can result in serious damage to the engine from overheating. Because of this troublesome deficiency of prior art thermostats, individuals living in moderate climates often remove the thermostat entirely from the cooling system of the automobile. Because the thermostat does not perform a critical function in moderate climates, removal of the thermostat provides a safeguard against catastrophic overheating of the internal combustion engine should the thermostat fail in a closed condition. However, when the thermostat is removed entirely from the cooling system, the normal flow of fluid through the cooling system is altered because the thermostat itself, even in an open condition, provides a restriction to the flow of fluid through the cooling system.

The primary purpose of the replacement element of the present invention is to permit removal of the thermostat from the cooling system of the automobile while still maintaining the proper rate of fluid flow through the coolant system of the particular vehicle.

Maintaining the proper rate of flow of coolant through the cooling system is essential to accomplishing optimum vehicle performance. For example, if the thermostat is removed and the device of the present invention is not installed, the coolant will flow through the radiator to rapidly permit proper cooling. Therefore, in the warmer part of the year the engine will tend to run too hot. By implanting the device of the invention into the cooling system, however, fluid flow will be slowed to permit optimum cooling of the fluid by the radiator. Conversely, during the cooler part of the year, the coolant will move too rapidly through the radiator and the engine will tend to run too cool. This is both harmful to engine performance and also prevent the vehicle heating system from functioning properly. By installing the device of the invention into the vehicle system in place of the thermostat, the rate of flow of fluid is reduced to allow the fluid to heat properly during the cooler months and to permit the heater to operate properly.

As will be better understood from the description which follows, the replacement element of the present invention is adapted to seat within the coolant system in the same location as the thermostat unit. Because of its novel construction, the device can be constructed to closely replicate high temperature restriction to fluid flow through the cooling system provided by the thermostat recommended for use with the particular automobile. More specifically, the replacement element of the present invention can be provided with a plurality of fluid flow apertures strategically sized and located so as to closely replicate the fluid flow characteristic of the fully open thermostat of the character installed as standard equipment in the particular vehicle.

SUMMARY OF THE INVENTION

It is an object of the present invention to provide a replacement element which can be used in place of the thermostat recommended for use in a particular type of automobile. The replacement element can be specifically configured to closely replicate the restriction to flow of fluid through the coolant system offered by the specified thermostat when the thermostat is in an open condition.

It is another object of the present invention to provide a replacement element of the aforementioned character which can be easily installed within the coolant system of the automobile in the same location as the thermostat unit provided as standard equipment with the vehicle.

Another object of the invention is to provide a replacement element as described in the preceding paragraphs which can be specifically tailored for use in a particular automobile, truck or other vehicular cooling system to provide the same restriction to fluid flow as is provided by the thermostat of the vehicle when the thermostat is operating in the high temperature mode.

Still another object of the present invention is to provide a replacement element which is of simple construction, involves no moving parts and is completely reliable in operation.

Yet another object of the invention is to provide a replacement element of the character described in the preceding paragraphs which can be manufactured inexpensively and which can be installed within the cooling system of an automobile by unskilled workers using standard tools.

DESCRIPTION OF THE INVENTION

Figure 4:
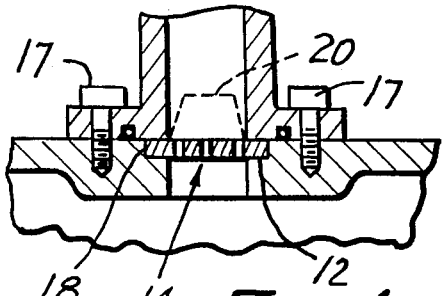
FIG. 4 is a cross-sectional view taken along lines 4—4 of FIG. 1 showing the appearance of the replacement element when in position within the cooling system of the automobile.
Figure 1:
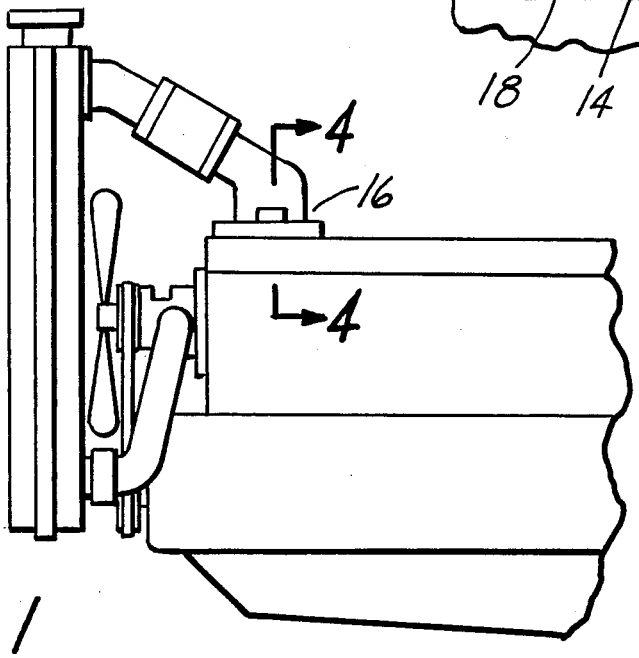
FIG. 1 is a generally diagramatic side elevational view of a portion of an internal combustion engine and the cooling system therefore.

Referring to the drawings and particularly to FIGS. 1 and 4, the fluid flow control element of the present invention is generally designated in FIG. 4 by the numeral 14. Typically, thermostat units installed within the cooling systems of internal combustion engines are provided with a flange portion which is engagable with a shoulder provided within the cooling system intermediate the engine and the radiator. For purposes of illustration, this shoulder is designated in FIG. 4 by the numeral 12 and is located proximate the top of the engine block within the area designated by the numeral 16 in FIG. 1. It is to be understood that the shoulder against which the thermostat rests may be located at various points within the cooling system depending upon the make and model of the vehicle.

When the thermostat unit is mounted within the cooling system in the manner depicted in FIG. 4 by the dotted lines, the lower flange of the thermostat rests upon the shoulder 12 and within a counter bore 18 provided in the engine block. The body portion of the thermostat typically extends upwardly within the fluid flow path into the area generally designated in FIG. 4 by the numeral 20.

Figure 2:
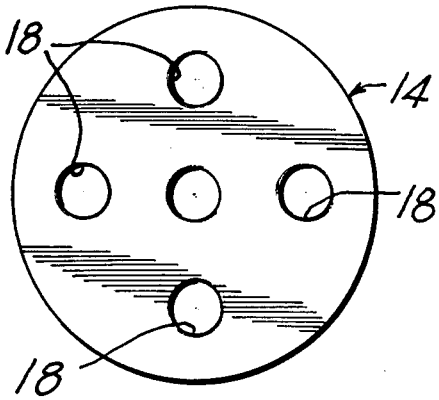
FIG. 2 is a plan view of the replacement element of the present invention.
Figure 3:
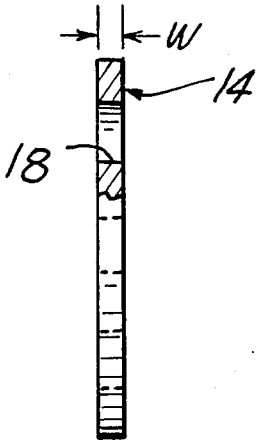
FIG. 3 is a side elevational view of the element shown partly in cross-section.

Referring also to FIGS. 2 and 3, the fluid flow control element, or thermostat replacement element 14, which is adapted to be mounted within the vehicle cooling system in the same location as the thermostat, of the present invention, can be seen to comprise a generally disc-shaped member having a predetermined wall thickness W (FIG. 3). The diameter and wall thickness of the element 14 generally corresponds to the diameter and thickness of the flange portion of the automobile thermostat which it replaces. With this construction, the thermostat can be removed, the replacement element sealed against the thermostat flange supporting shoulder, and the element clamped in place as for example by the bolts 17 shown in FIG. 4.

To closely regulate the flow of coolant through the cooling system, element 14 is provided with a plurality of spaced apart, fluid flow apertures 18. As best seen in FIG. 2, apertures 18 are generally circular in shape and are uniformly spaced apart within the peripheral boundary of the disc-shaped member.

An important aspect of the element of the present invention resides in the fact that the apertures 18 can be sized and specifically located within the periphery of the disc-shaped member so as to closely simulate the resistance to fluid flow offered by the full open thermostat which is to be replaced by the replacement element.

As previous discussed, the element of the present invention finds substantial use in geographic localities having moderate temperatures with minimum temperature swings during the year. Accordingly, it is preferable that the replacement element used in such geographic areas be adapted to simulate the resistance to flow of coolant offered by the given thermostat in a condition wherein the thermostat is in its open position permitting maximum flow of coolant through the automobile system. Because thermostat configurations vary from vehicle to vehicle, the resistance to fluid flow offered by a given thermostat when operating in a high temperature, or open mode, also varies considerably. However, by ascertaining this resistance for a given thermostat it is relatively easy to replicate it by properly sizing and locating the apertures 18 provided in the replacement element. Similarly, it is a simple matter to select from parts inventory a basic replacement element disc which has a diameter and thickness corresponding to the thicknesses of the flange of the thermostat that is to be replaced. Once the proper disc is selected and correctly drilled to provide the desired restriction to fluid flow, the replacement element can be installed within the vehicle cooling system quickly and easily by unskilled workers using standard tools.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A thermostat replacement element for use in a cooling system in which a continuous stream of coolant normally flows from a radiator through a thermostat to an engine, the thermostat being mounted within a mounting cavity and permitting maximum flow of coolant through the cooling system when in an open position, said replacement element comprising a disc-shaped member having a diameter substantially corresponding to the diameter of the mounting cavity, said member being provided with a plurality of apertures of a predetermined size to permit flow of coolant therethrough at a rate generally corresponding to the rate of flow of coolant through the thermostat when the thermostat is in an open position.

2. A thermostat replacement element as defined in claim 1 in which said disc-shaped member is of a predetermined uniform thickness and in which each aperture is generally circular in shape.

3. A thermostat replacement element as defined in claim 2 in which said disc-shaped element is provided with one centrally disposed aperture and four circumferentially spaced apertures.

4. A fluid flow control element for use in replacing a thermostat unit of the diameter typically found in automobile cooling systems, said thermostat unit including a flange portion engageable with a shoulder provided within the cooling system intermediate the engine and the radiator and being adapted to regulate coolant flow through the cooling system between maximum and minimum rates, said fluid flow control element comprising a generally disc-shaped member having a diameter and thickness generally corresponding to the diameter and thickness of the flange portion of the thermostat and having a plurality of fluid flow apertures constructed and arranged to permit fluid flow through the cooling system at a rate generally corresponding to the maximum fluid flow rate permitted by the thermostat.

5. A fluid flow control device as defined in claim 4 in which the apertures provided in said disc-shaped members are generally circular and are uniformly spaced apart within the peripheral boundary of said disc-shaped members.

* * * * *